US006000494A

United States Patent [19]

Wilson

[11] Patent Number: 6,000,494

[45] Date of Patent: Dec. 14, 1999

[54] SWIMMING POOL STEPS

[76] Inventor: Jean L. Wilson, 12 Cherry Lane, Kirkland, Quebec, Canada, H9H 4K2

[21] Appl. No.: 09/210,404

[22] Filed: Dec. 11, 1998

Related U.S. Application Data

[60] Provisional application No. 60/069,681, Dec. 12, 1997.

[51] Int. Cl.[6] ..... E06G 3/00; E06C 7/18

[52] U.S. Cl. ..... 182/93; 182/106; 4/496

[58] Field of Search ..... 182/82, 93, 106, 182/194; D25/65; 4/496

[56] References Cited

U.S. PATENT DOCUMENTS

D. 147,350 8/1947 Raffman ..... D25/65

5,065,840 11/1991 Cadigan ..... 182/93

5,333,323 8/1994 Aymes ..... 4/496

5,857,226 1/1999 Sonmer ..... 4/496

*Primary Examiner*—Alvin Chin-Shue

*Attorney, Agent, or Firm*—Eric Fincham

[57] ABSTRACT

A drop-in stair assembly for a pool which comprises alternating treads and risers forming a series of steps extending between first and second side walls and with a pair of L-shaped connectors, each of the connectors having first and second arms and an elbow portion, the arms having a plurality of attachment locations such that the stair unit can be aligned in both a horizontal and a vertical fashion with respect to a pool wall and rim.

5 Claims, 5 Drawing Sheets

SWIMMING POOL STEPS

This Appln claims the benefit of U.S. Provisional Appln. No. 60/069,681 Field Dec. 12, 1997.

BACKGROUND OF THE INVENTION

The present invention relates to a swimming pool step assembly and more particularly, relates to a swimming pool step assembly which may be used for either in ground or above ground pools.

Swimming pools have a high degree of popularity and a great number of residences have swimming pools in their backyards. The installation of both in ground and above ground pools continues to increase.

Above ground pools are usually formed of a side wall structure which, although it may be of different shapes, usually is arranged in the form of a circular, rectangular or ovoid configuration. The side walls provide the structural support while a liner is placed within the side walls and covers the ground and inner area defined by the side walls. The depth may vary with most pools having a depth ranging between 1 to 1.7 meters. Often the pools are sold with a deck area arranged to be constructed around the upper periphery of the pool or alternatively, the owner constructs such a deck.

In ground pools may be formed by a number of different methods and of different materials. Thus, while the construction of concrete pools is well known and widely practiced, there has been an increasing use of other materials to form a side wall within the ground and subsequently a liner having the desired configuration is placed thereover in a manner somewhat similar to above ground pools.

In either instance, the use of some form of ladder or stairs is considered to be desirable. Although the depth of the pools at the shallow end are usually in the order of 1 meter, gaining access thereto can be somewhat difficult especially for younger children and older people. Accordingly, the provision of steps is conventional.

In the case of in ground pools, and in particular with concrete pools, the steps are formed as an integral part of the side wall structure. For many of the other types of pools, the manufacture of steps becomes somewhat more difficult.

With above ground pools, access to the pools has generally been attained by provision of a ladder structure which is mounted to a side wall. These ladder structures generally comprise several rungs secured between side rails. While they serve the purpose, they suffer from several disadvantages including difficulty of use for young children and the elderly.

SUMMARY OF THE INVENTION

It is therefore an object of the present invention to provide a swimming pool step assembly which may be used in either above ground or below ground pools and which provides for adjustability.

According to one aspect of the present invention, there is provided a drop-in stair assembly for a pool, the drop-in assembly comprising a stair unit having first and second side walls, a plurality of alternating treads and risers extending between the first and second side walls, the alternating treads and risers forming a series of steps, a vertically extending channel formed in each of the first and second side walls, at least one side wall attachment location formed in each of the side walls in a respective one of the channels, a rear wall extending between the first and second side walls, the rear wall having openings therein to permit the flow of water therethrough, and a side wall recess formed in each of the side walls at a lower portion thereof; first and second L-shaped connectors, each of the first and second connectors having first and second arms and an elbow portion intermediate the first and second arms, a connector recess being formed in each of the connectors; a first arm of each of the L-shaped connectors being sized to fit within a respective one of the channels formed in the first and second side walls, each of the first arms having a plurality of first arm attachment locations aligned in a general vertical direction whereby one of the first arm attachment locations is in registry with the at least one side wall attachment location when the drop-in stair assembly is placed in a pool; each of the second arms having a plurality of second arm attachment locations for securement to a horizontal surface; and a handrail having a first vertical portion, a second vertical portion, and an intermediate portion, the first vertical portion fitting within a respective one of the side wall recesses, the second vertical portion being sized to fit within the connector recess formed in a respective one of the connectors.

The swimming pool step assembly of the present invention is designed for use in both above ground and in ground pools.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
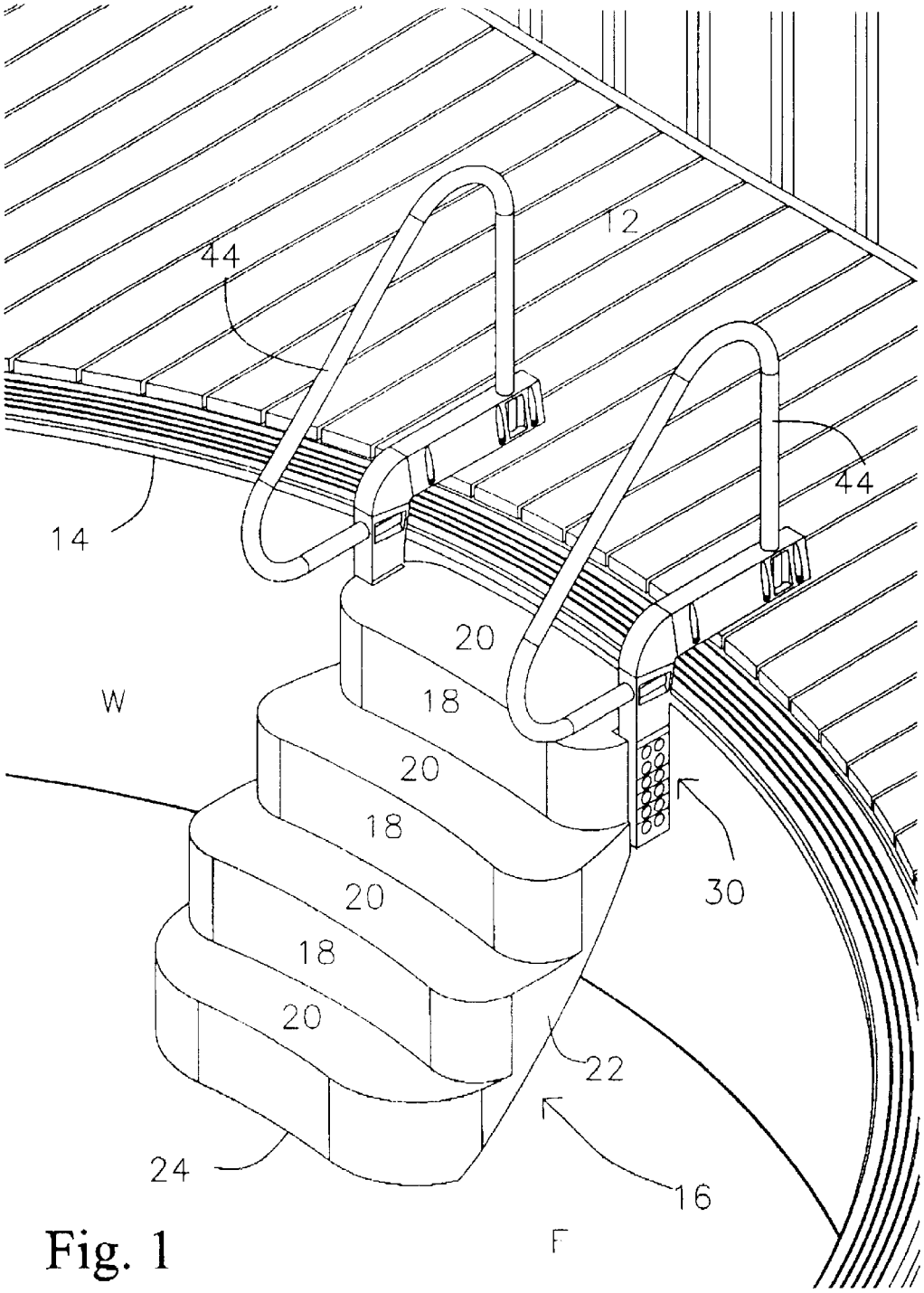
FIG. 1 is a perspective view of a swimming pool step assembly according to one embodiment of the present invention shown as used in an above ground pool.

Referring to the drawings in greater detail and by reference characters thereto, FIG. 1 illustrates a portion of an above ground type of pool having a pool wall 10 which terminates in an upper rim or edge 14. Extending outwardly from upper rim 14 is decking 12 or another suitable platform.

A swimming pool step assembly according to the present invention is generally designated by reference numeral 16. Step assembly 16 includes a plurality of treads or steps 20 interconnected by risers 18.

Side walls 22 of step assembly 16 extend between a base 24 of the step assembly 16 to the top step thereof. Base 24 is designed to seat on the floor F of the pool. The back of the step assembly has openings to permit the flow of water and addition of ballast.

Figure 2:
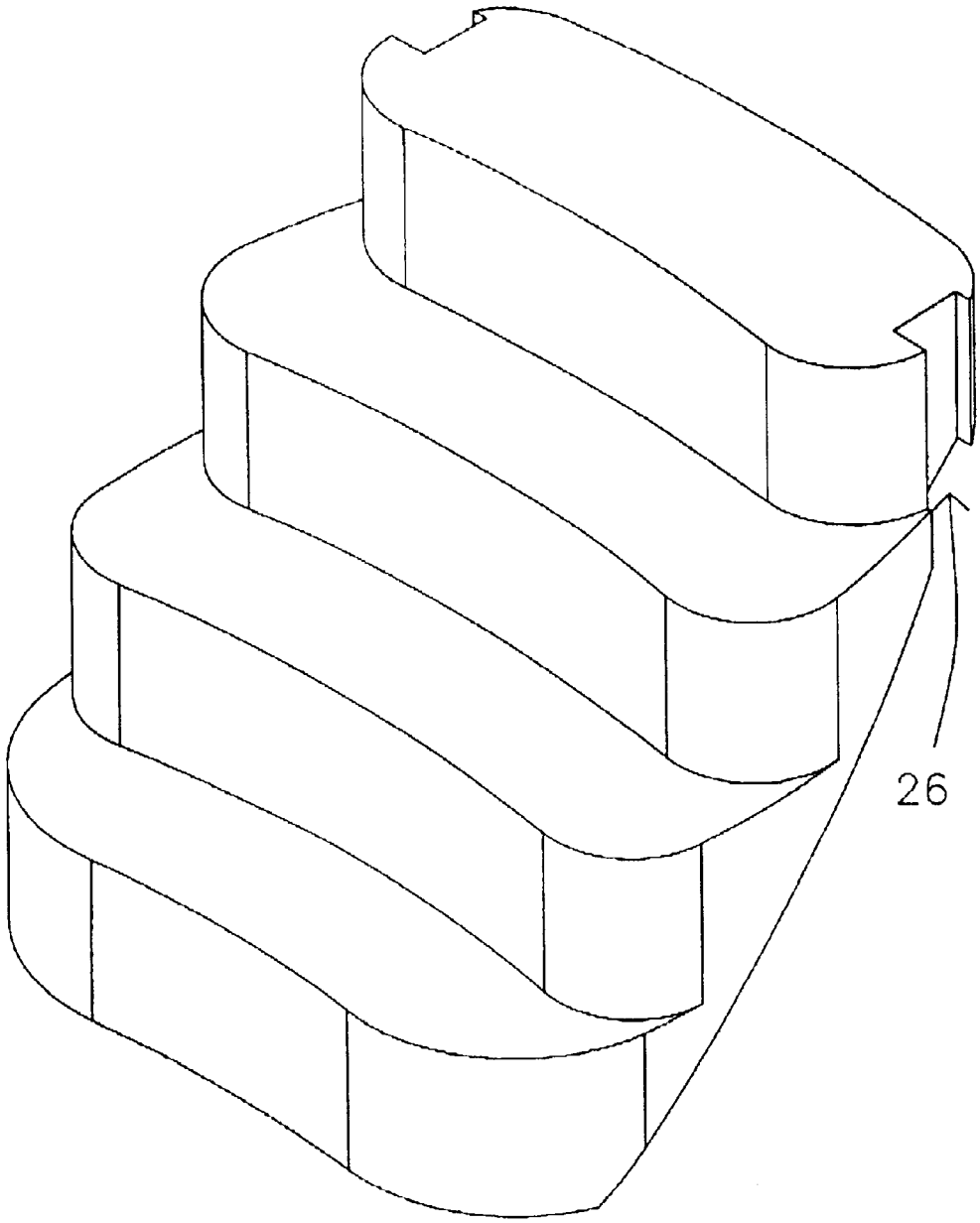
FIG. 2 is a perspective view of the step unit.

As may best be seen in FIG. 2, each side wall 22 has a vertically extending rectangular channel 26 located proximate the upper step of step assembly 16. Rectangular channel 26 is designed to receive a bracket or L-shaped connector 30 which fits therein. Thus, each side wall 22 of step assembly 16 is attached to decking 12 by means of connector 30.

Figure 3:
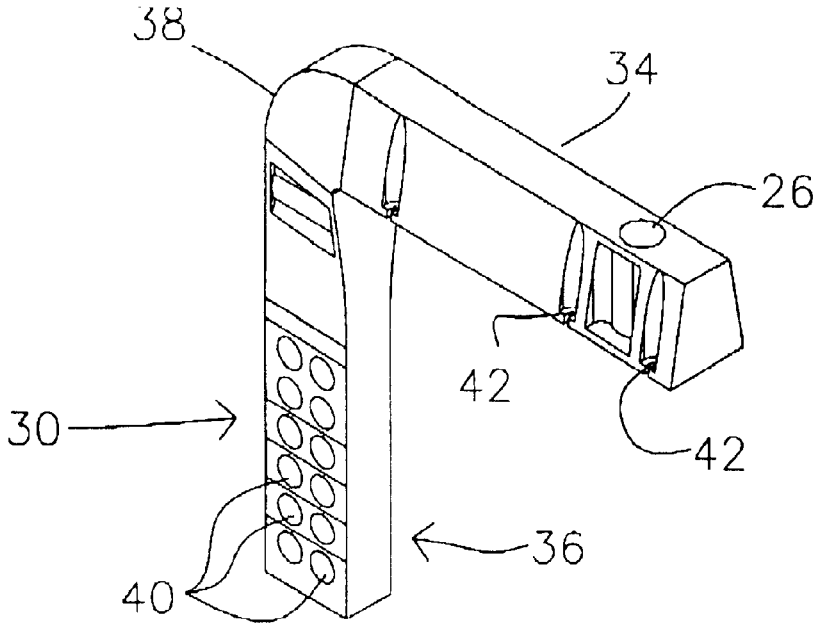
FIG. 3 is a perspective view of a connector bracket used for attaching the stairs to the pool deck.
Figure 4:
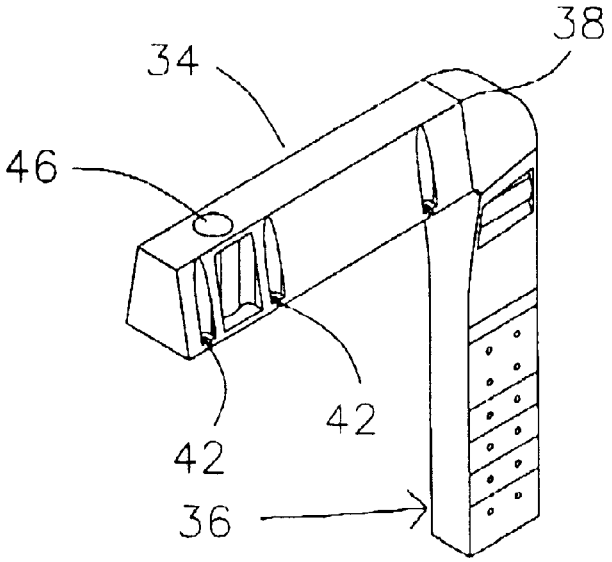
FIG. 4 is a perspective view of the bracket of FIG. 3 from the opposite side thereof.

Connector 30 is illustrated in FIGS. 3 and 4; each connector 30 is a substantial mirror image of the other and thus, only one will be described in detail herein. Connector 30 includes a first horizontal arm segment 34 and a vertical arm segment 36. Horizontal arm segment 34 and vertical arm segment 36 are interconnected by a 90° elbow 38.

As may be seen in FIGS. 3 and 4, vertical arm segment 36 includes a plurality of attachment locations 40 arranged in pairs while horizontal arm segment 34 includes attachment locations 42 along outer edges thereof. Attachment locations 40 and 42 are in the form of apertures designed to receive a fastener.

Apertures 40 in vertical arm segment 36 permit the attachment of vertical arm segment 36 to side wall 22 by means of suitable fasteners such as screws or bolts while horizontal arm segment 34 is secured to decking 12 through apertures 42 by means of suitable fasteners.

As will be seen in FIG. 1, handrails 44 are provided and which handrails 44 are held in place by means of brackets 30. To this end, a first end of handrail 44 will fit within a recess 46 formed in horizontal arm segment 34 while the other end will fit within a recess 48 formed at the upper end of vertical arm segment 36.

Figure 5:
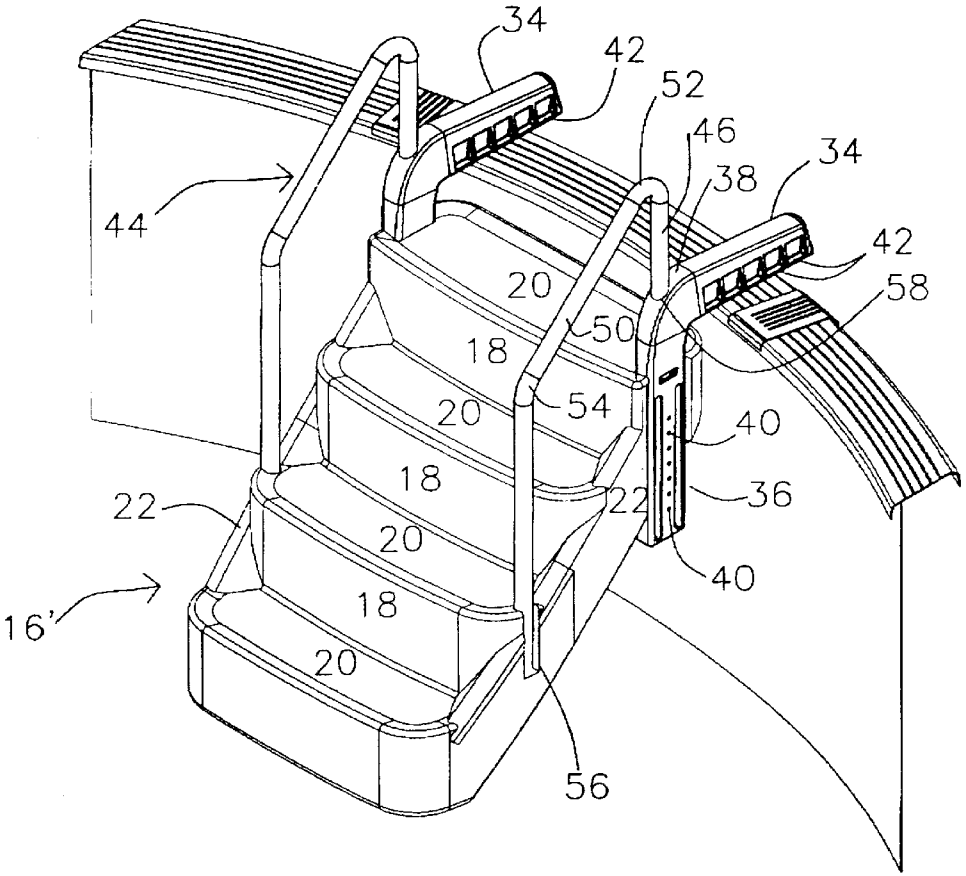
FIG. 5 is a perspective view, similar to FIG. 1, of a further embodiment of a stair assembly according to the present invention.
Figure 6:
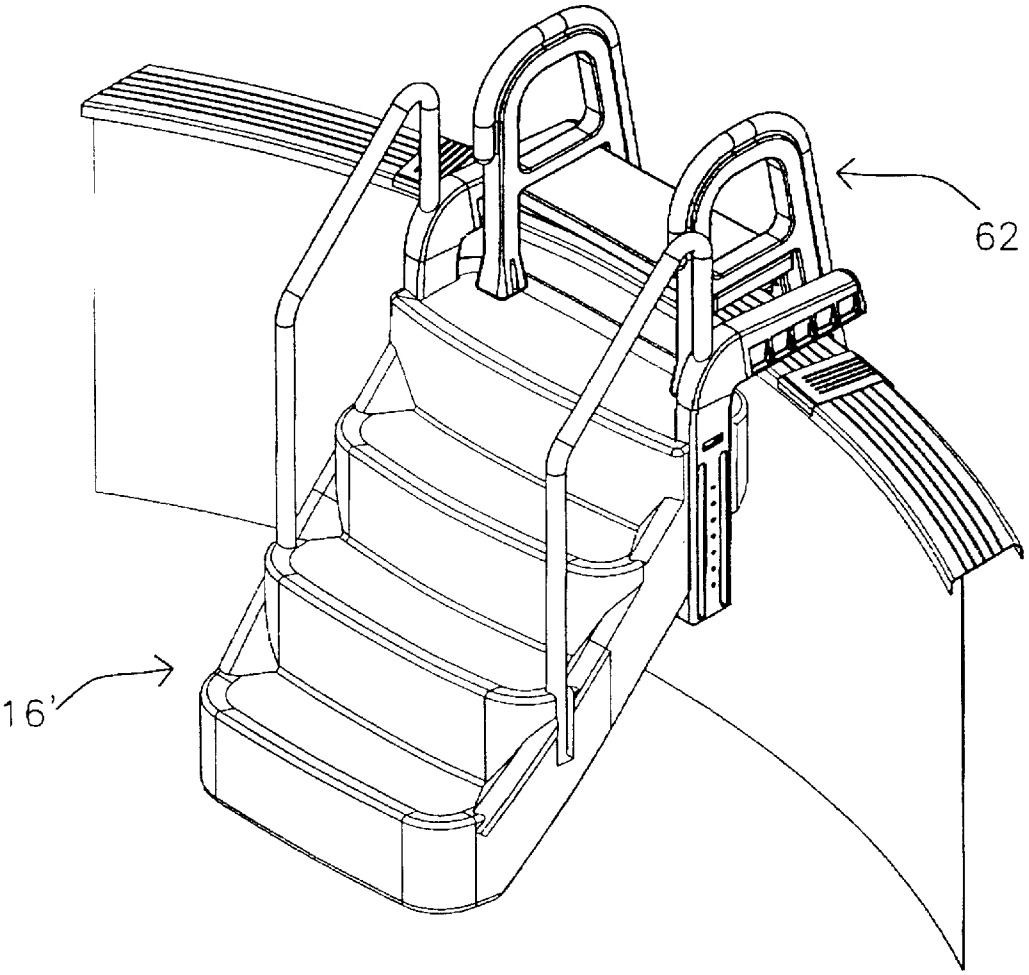
FIG. 6 is a perspective view of the stair assembly of FIG. 5 showing its use with a conventional exterior stair assembly.

Referring to FIG. 5, there is illustrated a second embodiment of a drop-in stair assembly. In this embodiment, reference numerals similar to those used with respect to the embodiment of FIGS. 1 to 4 are employed for similar components.

Swimming pool step assembly 16' has a plurality of steps 20 interconnected by risers 18. Side walls 22, as seen in FIG. 5, have a slightly greater height than the side walls of step assembly 16.

In this embodiment, horizontal arm segment 34 has five recesses with apertures 42 acting as attachment locations. Vertical arm 30 also has a plurality of aligned apertures 48 which align with an aperture within a channel formed in side wall 22. Thus, the step assembly can be placed in the pool and adjusted both for the height and for distance from the wall of the pool.

Handrails 44 are formed of a first vertical segment 46 which is seated within a recess 58 formed in elbow 38. A second vertical segment 48 seats within a recess 56 formed in side wall 22. An intermediate segment 50 is connected to vertical segments 46 and 48 by means of elbows 52 and 54.

As shown in FIG. 5, the drop-in step assembly of the present invention may be utilized in conjunction with a conventional exterior ladder used to gain access to above ground pools.

It will be understood that the above described embodiments are for purposes of illustration only and that changes and modifications may be made thereto without departing from the spirit and scope of the invention.

I claim:

1. A drop-in stair assembly for a pool, said drop-in assembly comprising:

a stair unit having first and second side walls, a plurality of alternating treads and risers extending between said first and second side walls, said alternating treads and risers forming a series of steps, a vertically extending channel formed in each of said first and second side walls, at least one side wall attachment location formed in each of said side walls in a respective one of said channels, a rear wall extending between said first and second side walls, said rear wall having openings therein to permit the flow of water therethrough, and a side wall recess formed in each of said side walls at a lower portion thereof;

first and second L-shaped connectors, each of said first and second connectors having first and second arms and an elbow portion intermediate said first and second arms, a connector recess being formed in each of said connectors;

a first arm of each of said L-shaped connectors being sized to fit within a respective one of said channels formed in said first and second side walls, each of said first arms having a plurality of first arm attachment locations aligned in a general vertical direction whereby one of said first arm attachment locations is in registry with said at least one side wall attachment location when said drop-in stair assembly is placed in a pool;

each of said second arms having a plurality of second arm attachment locations for securement to a horizontal surface; and a handrail having a first vertical portion, a second vertical portion, and an intermediate portion, said first vertical portion fitting within a respective one of said side wall recesses, said second vertical portion being sized to fit within said connector recess formed in a respective one of said connectors.

2. The drop-in stair assembly of claim 1 wherein said first arm attachment locations and said side wall attachment locations each comprise an aperture designed to receive a fastener.

3. The drop-in stair assembly of claim 1 wherein each of said connector recesses is formed in said elbow portion of said L-shaped connectors.

4. The drop-in stair assembly of claim 1 wherein each of said second arm attachment locations for securement to a horizontal surface comprises a plurality of aligned apertures designed to receive a fastening member.

5. The drop-in stair assembly of claim 1 further including first and second handrails situated on opposed sides of said steps.

* * * * *